US007432669B2

(12) United States Patent
Ahn et al.

(10) Patent No.: US 7,432,669 B2
(45) Date of Patent: Oct. 7, 2008

(54) BACKLIGHT UNIT AND METHOD FOR DRIVING THE SAME

(75) Inventors: In Ho Ahn, Taegu-kwangyokshi (KR); Jae Kyung Kang, Kumi-shi (KR); Jin Woo Hong, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 289 days.

(21) Appl. No.: 11/168,449

(22) Filed: Jun. 29, 2005

(65) Prior Publication Data

US 2006/0061305 A1 Mar. 23, 2006

(30) Foreign Application Priority Data

Sep. 23, 2004 (KR) ..... 10-2004-0076460

(51) Int. Cl.
*H05B 37/00* (2006.01)
*H05B 41/16* (2006.01)

(52) U.S. Cl. ..... 315/312; 315/276; 315/277

(58) Field of Classification Search ..... 315/312, 315/277

See application file for complete search history.

(56) References Cited

U.S. PATENT DOCUMENTS 5,615,093 A * 3/1997 Nalbant ..... 363/25
6,593,707 B1 * 7/2003 Shih ..... 315/277
6,949,890 B2 * 9/2005 Chou et al. ..... 315/294
7,002,304 B2 * 2/2006 Chan et al. ..... 315/282
2003/0001524 A1 * 1/2003 Lin et al. ..... 315/312
2003/0035283 A1 * 2/2003 Lim ..... 362/97
2004/0119418 A1 * 6/2004 Moon ..... 315/169.3
2004/0183465 A1 * 9/2004 Jang ..... 315/224
2006/0006803 A1 * 1/2006 Huang et al. ..... 313/607
2006/0193120 A1 * 8/2006 Huang ..... 362/33
2007/0120499 A1 * 5/2007 Shimura et al. ..... 315/277

FOREIGN PATENT DOCUMENTS

JP 2003-0000468 A 6/2003

* cited by examiner

*Primary Examiner*—Trinh V Dinh
(74) *Attorney, Agent, or Firm*—Birch, Stewart, Kolasch & Birch, LLP

(57) ABSTRACT

A backlight unit includes a plurality of fluorescent lamps driven by one inverter in a manner to prevent wave noise. A first common electrode line connects respective first ends of the odd numbered fluorescent lamps in common. A second common electrode line connects respective first ends of the even numbered fluorescent lamps in common. A third common electrode line connects the second ends of the odd and even numbered fluorescent lamps in common. Voltages having opposite phases are respectively applied to the first common electrode line and the second common electrode line.

14 Claims, 3 Drawing Sheets

BACKLIGHT UNIT AND METHOD FOR DRIVING THE SAME

This application claims the benefit of the Korean Application No. P2004-76460 filed on Sep. 23, 2004, which is hereby incorporated by reference.

BACKGROUND OF THE INVENTION

1. Field of the Invention

The present invention relates to a backlight unit, and more particularly, to a backlight unit and a method for driving the same, to drive a plurality of fluorescent lamps by one inverter, and to prevent wave noise.

2. Discussion of the Related Art

A cathode ray tube (CRT) has been widely used as a monitor of a television, a measuring apparatus, and an information terminal, such as for a personal computer. However, the CRT is not compact in size or light in weight. Thus, various alternative display devices have been developed. For example, a liquid crystal display (LCD) device using an electric field optical effect, a plasma display panel (PDP) using gas discharge, and an electroluminescence display (ELD) device using an electric field luminous effect, have been employed as substitutes for the CRT.

Among the various substitute display devices, the LCD device has been most extensively researched. The LCD device has low power consumption, is slim, and is lightweight. The LCD device is in active development and is being used as a monitor for desktop computers (or personal computers) and large sized display devices, as well as laptop computers (or notebook computers). Accordingly, LCD devices are continuously in demand. Most LCD devices control light transmittance of ambient light to display an image. In this respect, it is necessary to form an additional light source, such as a backlight unit, for an LCD panel.

Generally, the backlight unit used as the light source of the LCD device is classified into two types, namely a direct type or an edge type, according to the arrangement of the fluorescent lamps thereof.

In the edge type backlight unit, a lamp unit is provided at a lateral side of a light-guiding plate. The lamp unit is provided with a fluorescent lamp for emitting light. A lamp holder holds both ends of the fluorescent lamp for protection of the fluorescent lamp. A reflective sheet reflects the light emitted from the fluorescent lamp to the light-guiding plate.

The edge type backlight unit is generally used in relatively small-sized LCD devices, such as monitors of laptop computers and desktop computers, since the edge type backlight is advantageous in that it provides light uniformity, a long lifespan, and allows for a thin profile of the LCD device.

The present trend is to produce large-sized LCD devices, e.g. of 20-inch or more. For large-sized LCD devices, the direct type backlight unit is actively developed, in which a plurality of lamps are formed in one line on a lower surface of a light-diffusion sheet, whereby an entire surface of the LCD panel is directly illuminated with the light produced by the lamps. A direct type backlight unit is used for a large-sized LCD device because the large-sized LCD requires a high luminance. The direct type backlight unit has greater light efficiency, as compared with the light efficiency of the edge-type backlight unit.

Hereinafter, a backlight unit, in accordance with the background art, will be described with reference to the accompanying drawings. FIG. 1 is a plan view illustrating an arrangement of a backlight unit according to one method of the background art. FIG. 2 is a plan view of illustrating an arrangement of a backlight unit according to another method of the background art.

As shown in FIG. 1, the backlight unit, according to one method of the background art, includes a lamp housing 10. The lamp housing 10 is provided with a plurality of fluorescent lamps 12 arranged at fixed intervals, wherein each fluorescent lamp 12 has first and second electrodes 11*a* and 11*b* formed at respective ends of a tube thereof. First and second power supplying lines 13*a* and 13*b* are provided at the first and second electrodes 11*a* and 11*b* to supply power thereto. A condenser 14 is connected with each the first power supplying lines 13*a* for each of the fluorescent lamps 12. A first end of an output coil of a transformer 15 is connected with the condenser 14, and a second end of the output coil is connected to the second power supplying line 13*b*. The second power supplying lines 13*b* are grounded with the lamp housing 10.

As shown in FIG. 2, the backlight unit, according to another method of the background art, includes a lamp housing 20. The lamp housing 20 is provided with a plurality of fluorescent lamps 22 arranged at fixed intervals, wherein each fluorescent lamp 22 has first and second electrodes 21*a* and 21*b* formed at ends of a tube thereof. First and second power supplying lines 23*a* and 23*b* are provided at the first and second electrodes 21*a* and 21*b* to supply power thereto. First and second condensers 24*a* and 24*b* are respectively connected with the first and second power supplying lines 23*a* and 23*b*. The first condensers 24*a* are connected with one end of an output coil of a first transformer 25*a* in common. The second condensers 24*b* are connected with one end of an output coil of a second transformer 25*b* in common. The other ends of the output coils of the first and second transformers 25*a* and 25*b* are grounded with the lamp housing 20.

In the aforementioned backlight unit according to another method of the background art as shown in FIG. 2, positive and negative polarity voltages having the same level are respectively applied to the first and second electrodes 21*a* and 21*b*. As a result, the same phase voltage is applied to the first or second electrodes 21*a* or 21*b*. For example, if the positive polarity voltage is applied to all the first electrodes 21*a*, the negative polarity voltage is applied to all the second electrodes 21*b*. Conversely, if the negative polarity voltage is applied to all the first electrodes 21*a*, the positive polarity voltage is applied to all the second electrodes 21*b*.

In FIG. 1 and FIG. 2, the condensers 14, 24*a* and 24*b* prevent any sharp increase of discharge current when separately driving the fluorescent lamps. Also, in case of driving the plurality of fluorescent lamps connected in parallel by one power device, the condensers uniformly divide the current, thereby obtaining uniform luminance in the respective fluorescent lamps.

However, the background art backlight unit has several drawbacks. In the case of the backlight unit of FIG. 1, the condenser is connected with one electrode of each of the fluorescent lamps. In this state, a high voltage is applied to one electrode in each fluorescent lamp, and the other electrode of the fluorescent lamp is grounded, whereby the backlight unit is driven by a high-low method. That is, the electrode having the high voltage is firstly luminous, and then it is luminous toward the grounded electrode. Accordingly, the electrode portion of the fluorescent lamp to which the high voltage is applied is brighter than the grounded electrode portion of the fluorescent lamp, so that it is impossible to realize a uniform luminance in the fluorescent lamp.

In the case of the backlight unit of FIG. 2, the condensers 24*a* and 24*b* are respectively connected with both ends of each of the fluorescent lamps, whereby the condensers and the electrodes are provided in parallel. In this arrangement, if the same phase voltage is applied to the electrodes provided at the same side of the backlight unit, it may generate bit frequency due to frequency interference between the fluorescent lamps arranged at the same side of the backlight unit, thereby causing noise. Accordingly, when the backlight unit is mounted to an LCD panel, wave noise may be generated due to the noise of the backlight unit.

SUMMARY OF THE INVENTION

The present invention is directed to a backlight unit that substantially obviates one or more of the drawbacks, problems, limitations or disadvantages of the background art.

An object of the present invention is to provide a backlight unit, having a plurality of fluorescent lamps driven by one inverter, to prevent wave noise.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

These and other objects are accomplished by a backlight unit including a plurality of lamps, each lamp having a first electrode at a first end and a second electrode at a second end; a first common electrode line connected with first electrodes of a first set of lamps included in said plurality of lamps; a second common electrode line connected with first electrodes of a second set of lamps included in said plurality of lamps; and a third common electrode line connected with second electrodes of said first and second sets of lamps.

Further, these and other objects are accomplished by a backlight unit including a plurality of first power supply lines, each for connecting to first electrodes at first ends of a plurality of lamps; a first common electrode line connected with a first set of said plurality of first power supply lines; a second common electrode line connected with a second set of said plurality of first power supply lines; a plurality of second power supply lines, each for connecting to second electrodes at second ends of the plurality of lamps; and a third common electrode line connected with said plurality of second power supply lines.

Moreover, these and other objects are accomplished by a method of driving a backlight unit comprising the steps of: providing a plurality of lamps, each lamp having a first electrode at a first end and a second electrode at a second end; and applying a voltage having a first phase to the first electrodes of a first set of lamps of the plurality of lamps, while applying a voltage having a second, different phase to the first electrodes of a second set of lamps of the plurality of lamps.

The power supplying device may include one or more transformers. Also, the backlight unit may include current restricting elements, respectively provided between the first common electrode line and each of the fluorescent lamps, and between the second electrode line and each of the fluorescent lamps. The third common electrode line may be grounded.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a backlight unit and a method for driving the same according to the present invention will be described with reference to the accompanying drawings.

Figure 1:
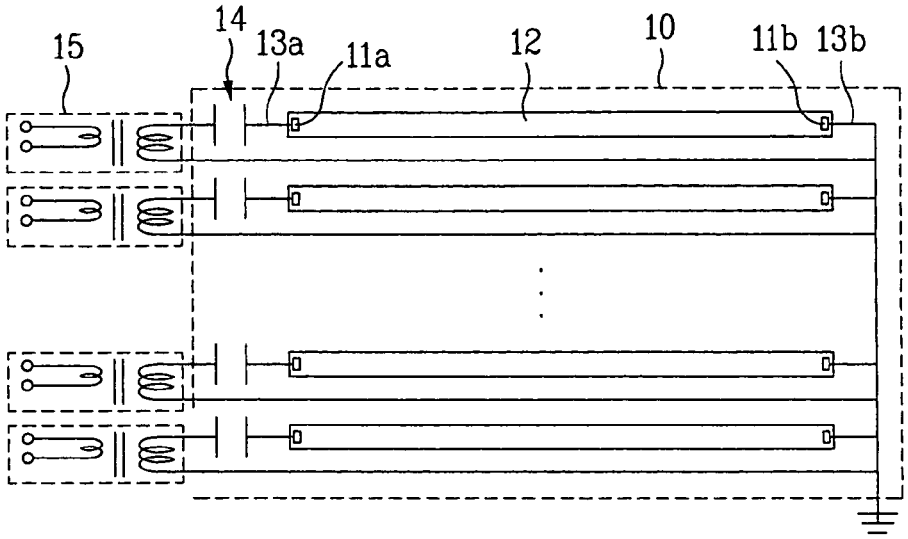
FIG. 1 BACKGROUND ART
FIG. 1 is a plan view illustrating an arrangement of a backlight unit according to one method of the background art.
Figure 2:
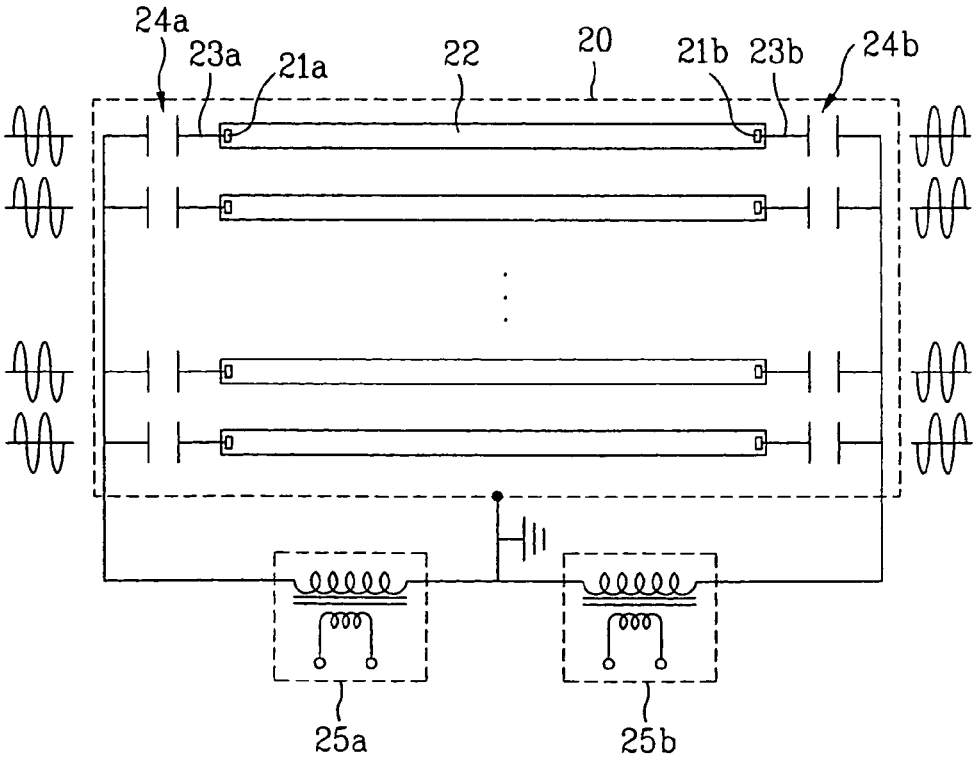
FIG. 2 BACKGROUND ART
FIG. 2 is a plan view illustrating an arrangement of a backlight unit according to another method of the background art.
Figure 3:
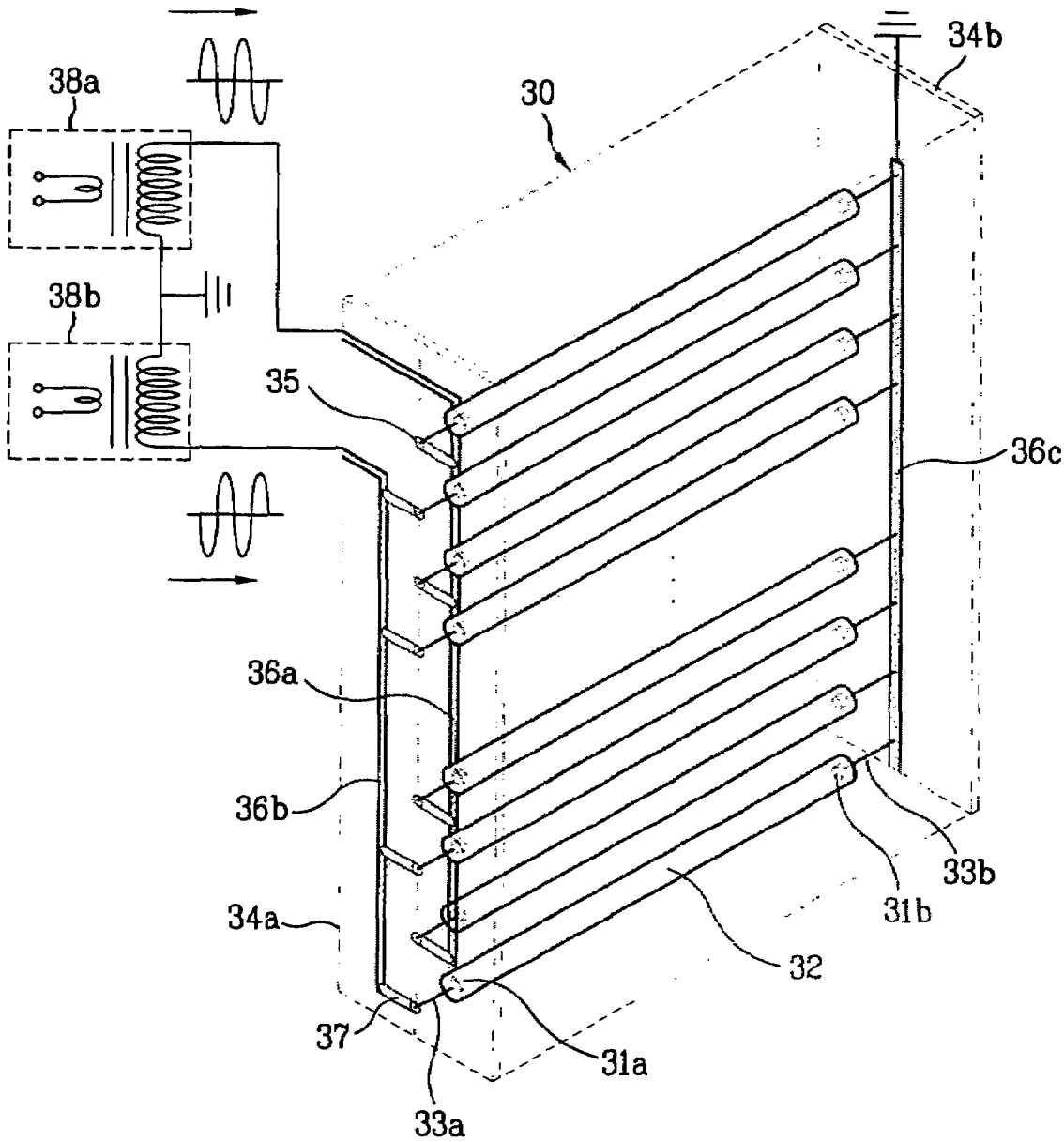
FIG. 3 is a perspective view illustrating a backlight unit according to an embodiment of the present invention.
Figure 4:
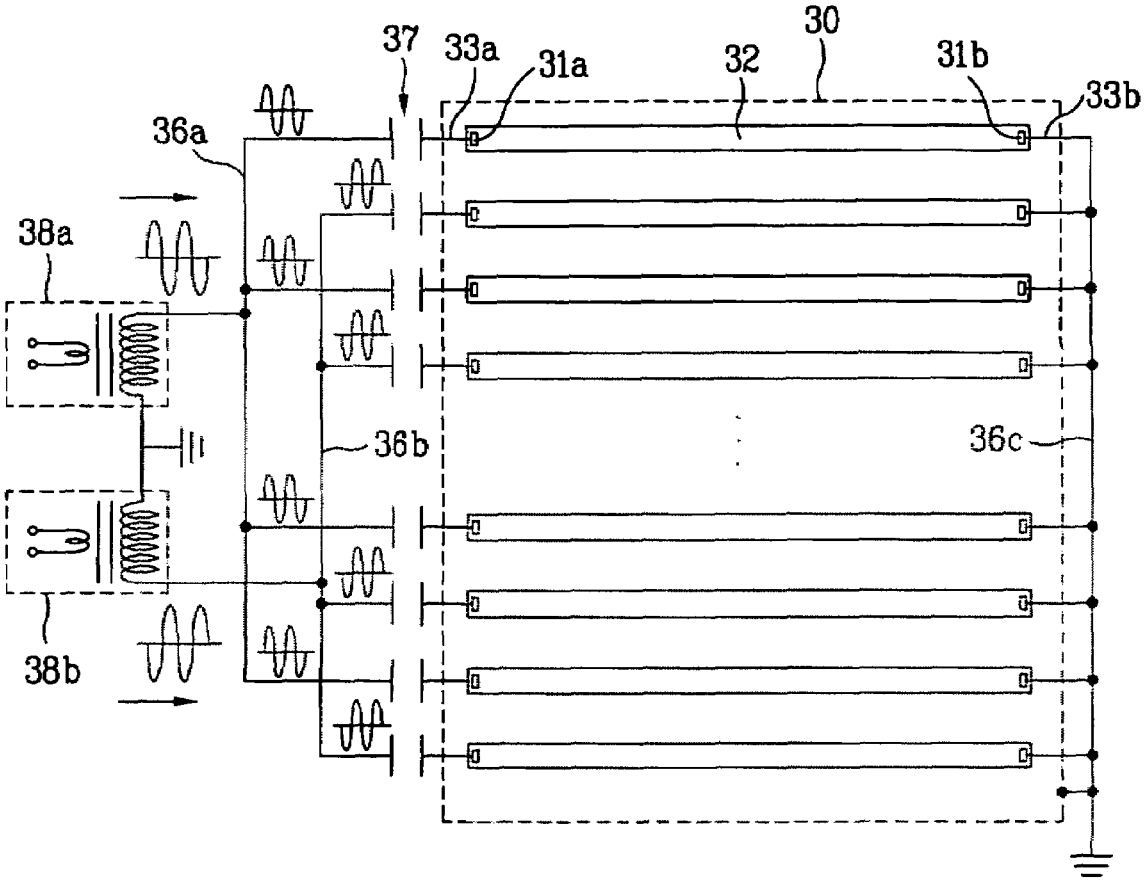
FIG. 4 is a plan view illustrating a driving method of a backlight unit according to the present invention.

As shown in FIG. 3 and FIG. 4, the backlight unit according to the present invention includes a lamp housing 30. The lamp housing 30 is provided with a plurality of fluorescent lamps 32 arranged at fixed intervals, wherein each fluorescent lamp 32 has first and second electrodes 31*a* and 31*b* formed at respective ends of a tube thereof. First and second printed circuit boards 34*a* and 34*b* are provided at respective sides of the lamp housing 30, wherein the first and second printed circuit boards 34*a* and 34*b* are positioned adjacent to respective ends of each of the fluorescent lamps 32.

Each of the first and second printed circuit boards 34*a* and 34*b* has a plurality of holes 35. In addition, first and second power supplying lines 33*a* and 33*b* for transmitting power are respectively connected with the first and second electrodes 31*a* and 31*b* by passing through the holes 35 of the first and second printed circuit boards 34*a* and 34*b*.

First and second common electrode lines 36*a* and 36*b* are formed at a predetermined interval on the first printed circuit board 34*a*. A third common electrode line 36*c* is formed on the second printed circuit board 34*b*. Current restricting elements 37 are respectively connected between the first common electrode line 36*a* and each of the first power supplying lines 33*a* corresponding to the odd numbered fluorescent lamps 32. Also, current restricting elements 37 are respectively connected between the second common electrode line 36*b* and each of the first power supplying lines 33*a* corresponding to the even numbered fluorescent lamps 32.

First and second transformers 38*a* and 38*b* are provided to supply power to the first and second common electrode lines 36*a* and 36*b*, respectively. Specifically, the first common electrode line 36*a* is connected with one end of an output coil of the first transformer 38*a*, and the second common electrode line 36*b* is connected with one end of an output coil of the second transformer 38*b*. Also, the other ends of the first and second transformers 38*a* and 38*b* are grounded in common. The first and second transformers 38*a* and 38*b* may be provided in one inverter. The second power supplying lines 33*b* are connected and grounded with the third common electrode line 36*c* in common.

The current restricting elements 37 may be formed as condensers. Condensers prevent the sharp increase of discharge current when separately driving the fluorescent lamps. Also, when driving the plurality of fluorescent lamps connected in parallel by one power device, the condensers uniformly divide the current, thereby maintaining uniform luminance in each of the fluorescent lamps.

The power supplying lines of the odd numbered fluorescent lamps are connected to one another, and the power supplying lines of the even numbered fluorescent lamps are connected to one another, so that more than two fluorescent lamps 32 are driven in parallel by one inverter including the first and second transformers 38*a* and 38*b*.

A method for driving the backlight unit according to the present invention will be described as follows. As shown in FIG. 3 and FIG. 4, the positive polarity voltage is applied to the first power supplying lines 33*a* of the odd numbered fluorescent lamps 32 connected to one another by the first common electrode line 36*a*, and the negative polarity voltage is applied to the first power supplying lines 33*a* of the even numbered fluorescent lamps 32 connected to one another by the second common electrode line 36*b*. Also, a ground voltage 0V is applied to the second power supplying lines 33*b* connected to one another by the third common electrode line 36*c*.

The first power supplying lines 33*a*, corresponding to the odd numbered fluorescent lamps 32, are driven by the first transformer 38*a*, and the first power supplying lines 33*a* corresponding to the even numbered fluorescent lamps 32 are driven by the second transformer 38*b*.

Also, the negative polarity voltage may be applied to the first power supplying lines 33*a* corresponding to the odd numbered fluorescent lamps 32, and the positive polarity voltage may be applied to the first power supplying lines 33*a* corresponding to the even numbered fluorescent lamps 32. That is, voltages having opposite phases are separately applied to the odd numbered fluorescent lamps and the even numbered fluorescent lamps.

In the backlight unit according to the present invention, the positive polarity voltage and the negative polarity voltage are alternately provided to the plurality of fluorescent lamps arranged along one direction, so that it is possible to prevent noise generated by frequency interference between the fluorescent lamps, thereby preventing wave noise.

As described above, the backlight unit and the method for driving the same according to the present invention have several advantages over the background art. For example, it is possible to drive the plurality of fluorescent lamps in parallel by one inverter having first and second transformers.

Also, the positive polarity voltage and the negative polarity voltage are separately provided to the even numbered fluorescent lamps and the odd numbered fluorescent lamps arranged along one direction, so that it is possible to prevent noise generated by frequency interference between the fluorescent lamps, thereby preventing wave noise.

Although the drawing figures have illustrated the plurality of fluorescent lamps as arranged parallel to one another, it should be appreciated that the fluorescent lamps could be arranged in any desirable configuration relative to each other, such as a non-parallel arrangement. Also, the drawing figures have illustrated the plurality of fluorescent lamps extending from proximate one edge of the backlight unit to proximate an opposite edge of the backlight unit. It should be appreciated that the lamps need not fully extend between the side edges of the backlight unit. Rather, the lamps could be staggered or stepped in the backlight unit, with the first or second power supplying lines 33*a* or 33*b* extending from the respective first or second printed circuit board 34*a* or 34*b* to the stepped or staggered lamp.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A backlight unit comprising:

a plurality of lamps, each lamp having a first electrode at a first end and a second electrode at a second end;

a first common electrode line connected with first electrodes of a first set of lamps included in said plurality of lamps;

a second common electrode line connected with first electrodes of a second set of lamps included in said plurality of lamps;

a third common electrode line connected with second electrodes of said first and second sets of lamps; and a power supplying device for separately applying voltages having opposite phases to said first common electrode line and said second common electrode line, wherein said third common electrode line is grounded.

2. The backlight unit of claim 1, wherein said plurality of lamps are fluorescent lamps.

3. The backlight unit of claim 1, wherein each lamp of said plurality of lamps is linear in shape, and wherein said plurality of lamps are arranged to extend parallel to one another.

4. The backlight unit of claim 1, wherein each lamp of said plurality of lamps extends from proximate one edge of said backlight unit to proximate an opposite edge of said backlight unit.

5. The backlight unit of claim 1, wherein lamps of said first set of lamps alternate in position with lamps of said second set of lamps inside said backlight unit.

6. The backlight unit of claim 5, wherein said first set of lamps occupy odd numbered positions in said backlight unit, and said second set of lamps occupy even numbered positions in said backlight unit.

7. The backlight unit of claim 1, wherein said power supplying device includes a first transformer and a second transformer, and wherein said first common electrode line is connected with one end of an output coil of said first transformer, said second common electrode line is connected with one end of an output coil of said second transformer, and the other ends of said first and second transformers are grounded.

8. The backlight unit of claim 1, further comprising:

current restricting elements respectively provided between said first common electrode line and said first electrode of each of the lamps of said first set of lamps, and between said second electrode line and said first electrode of each of the lamps of said second set of lamps.

9. The backlight unit of claim 8, wherein said current restricting elements include condensers.

10. The backlight unit of claim 1, further comprising:

a first printed circuit board located proximate a first edge of said backlight unit, wherein said first and second common electrode lines are formed on said first printed circuit board; and a second printed circuit board located proximate a second edge of said backlight unit, wherein said third common electrode line is formed on said second circuit board.

11. A backlight unit comprising:

a plurality of first power supply lines, each for connecting to first electrodes at first ends of a plurality of lamps;

a first common electrode line connected with a first set of said plurality of first power supply lines;

a second common electrode line connected with a second set of said plurality of first power supply lines;

a plurality of second power supply lines, each for connecting to second electrodes at second ends of the plurality of lamps;

a third common electrode line connected with said plurality of second power supply lines; and a power supplying device for separately applying voltages having opposite phases to said first common electrode line and said second common electrode line, wherein said third common electrode line is grounded.

12. The backlight unit of claim 11, wherein said power supplying device includes a first transformer and a second transformer, and wherein said first common electrode line is connected with one end of an output coil of said first transformer, said second common electrode line is connected with one end of an output coil of said second transformer, and the other ends of said output coils of said first and second transformers are grounded.

13. The backlight unit of claim 11, further comprising:

current restricting elements respectively provided between said first common electrode line and said first set of said plurality of first power supply lines, and between said second electrode line and said second set of said plurality of first power supply lines.

14. The backlight unit of claim 13, wherein said current restricting elements include condensers.

* * * * *